US011328915B2

(12) United States Patent
Schwieters et al.

(10) Patent No.: US 11,328,915 B2
(45) Date of Patent: May 10, 2022

(54) METHODS IN MASS SPECTROMETRY USING COLLISION GAS AS ION SOURCE

(71) Applicant: Thermo Fisher Scientific GmbH, Bremen (DE)

(72) Inventors: Johannes Schwieters, Ganderskesee (DE); Henning Wehrs, Bremen (DE); Jamie Lewis, Bristol (GB)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 81 days.

(21) Appl. No.: 16/857,117

(22) Filed: Apr. 23, 2020

(65) Prior Publication Data

US 2020/0251322 A1 Aug. 6, 2020

Related U.S. Application Data

(62) Division of application No. 15/903,842, filed on Feb. 23, 2018, now Pat. No. 10,651,023.

(30) Foreign Application Priority Data

Feb. 23, 2017 (GB) ..... 1702953

(51) Int. Cl.
*H01J 49/26* (2006.01)
*H01J 49/10* (2006.01)
(Continued)

(52) U.S. Cl.
CPC ..... *H01J 49/0031* (2013.01); *H01J 49/005* (2013.01); *H01J 49/0077* (2013.01);
(Continued)

(58) Field of Classification Search
CPC ..... H01J 49/0031; H01J 49/0072; H01J 49/0077; H01J 49/105
See application file for complete search history.

(56) References Cited

U.S. PATENT DOCUMENTS 4,870,276 A 9/1989 Lindinger
5,049,739 A 9/1991 Okamoto
(Continued)

FOREIGN PATENT DOCUMENTS

CN 103038858 A 4/2013
CN 103329242 A 9/2013
(Continued)

OTHER PUBLICATIONS

Douglas, "Some Current Perspectives on ICP-MS," Canadian Journal Spectroscopy, 34(2), 38-49, 1989.
(Continued)

*Primary Examiner* — Eliza W Osenbaugh-Stewart

(57) ABSTRACT

A mass spectrometry method comprising steps of generating an ion beam from an ion source; directing the ion beam into a collision cell; introducing into the collision cell through a gas inlet on the collision cell a charge-neutral analyte gas or reaction gas; ionizing the analyte gas or reaction gas in the collision cell by means of collisions between the analyte gas or reaction gas and the ion beam; transmitting ions from the ionized analyte gas or reaction gas from the collision cell into a mass analyzer; and mass analyzing the transmitted ions of the ionized analyte or reaction gas. The methods can be applied in isotope ratio mass spectrometry to determine the isotope abundance or isotope ratio of a reaction gas used in mass shift reactions between the gas and sample ions, to determine a corrected isotope abundance or ratio of the sample ions.

7 Claims, 3 Drawing Sheets

(51) Int. Cl.

| | |
|---|---|
| ***H01J 49/00*** | (2006.01) |
| ***H01J 49/14*** | (2006.01) |
| ***H01J 49/04*** | (2006.01) |
| ***H01J 49/06*** | (2006.01) |
| ***H01J 49/42*** | (2006.01) |

(52) U.S. Cl.

CPC ..... *H01J 49/045* (2013.01); *H01J 49/062* (2013.01); *H01J 49/105* (2013.01); *H01J 49/14* (2013.01); *H01J 49/145* (2013.01); *H01J 49/421* (2013.01); *H01J 49/4225* (2013.01)

(56) References Cited

U.S. PATENT DOCUMENTS

| | | | | |
|---|---|---|---|---|
| 2003/0116705 | A1 | 6/2003 | Kanik et al. | |
| 2006/0113464 | A1* | 6/2006 | Litherland ..... | B01D 59/44 250/288 |
| 2009/0039251 | A1 | 2/2009 | Yamada et al. | |
| 2011/0266437 | A1 | 11/2011 | Park | |
| 2012/0003748 | A1 | 1/2012 | Robinson et al. | |
| 2013/0264475 | A1 | 10/2013 | Ivashin et al. | |
| 2015/0318159 | A1* | 11/2015 | Badiei ..... | H01J 49/0027 250/282 |
| 2016/0189948 | A1 | 6/2016 | Breitenlechner et al. | |
| 2017/0084447 | A1* | 3/2017 | Rottmann ..... | H01J 49/0045 |

FOREIGN PATENT DOCUMENTS

| | | | |
|---|---|---|---|
| DE | 112016003713 | T5 | 5/2018 |
| EP | 0813228 | A1 | 12/1997 |
| JP | S5512632 | A | 1/1980 |
| WO | WO-9725737 | A1 | 7/1997 |

OTHER PUBLICATIONS

Eiden et al., "Selective Removal of Plasma Matrix Ions in Plasma Source Mass Spectrometry," J. Anal. At. Spec., 11, 317-322, 1996.

Hattendorf et al., "Suppression of in-cell generated interferences in a reaction cell ICP-MS by bandpass tuning and kinetic energy discrimination," J. Anal. At. Spectrom., 2004, 19, pp. 600-606.

Koppenaal et al., "Collision and reaction cells in atomic mass spectrometry: development, status, and applications," J. Anal. At. Spectrom., 19, 561-570, 2004.

Tanner et al., "Reaction cells and collisions cells for ICP-MS: a tutorial review", Spectrochimica Acta Part B 57 (2002), 1361-1452.

Thermo Scientific, "NEPTUNE Plus Multicollector ICPMS—Another step ahead in MC-ICP-MS", 2010, pp. 1-12.

Thermo Scientific, "Thermo Scientific NEPTUNE Multicollector ICP-MS—High Resolution Multicollector Mass Spectrometers"—brochure, 2007, pp. 1-16.

Thomas, R, "A Beginner's Guide to ICP-MS—Part XIII—A Review of Interfaces", Spectroscopy 17 (1 0), 2002, pp. 24-31.

Weyer et al., "High precision Fe isotope measurements with high mass resolution MC-ICPMS," Int. J. Mass Spec., 226,355-368, 2003.

* cited by examiner

METHODS IN MASS SPECTROMETRY USING COLLISION GAS AS ION SOURCE

CLAIM TO PRIORITY

This application is a divisional application of U.S. patent application Ser. No. 15/903,842, filed Feb. 23, 2018. U.S. application Ser. No. 15/903,842 claims the benefit of Great Britain patent application no. GB 1702953.9, entitled "Methods in Mass Spectrometry Using Collision Gas as ION Source," by Johannes Schwieters, and filed on Feb. 23, 2017. The content of the above-identified application is incorporated herein by reference in its entirety.

STATEMENT RELATING TO FUNDING

The work leading to this invention has received funding from the European Research Council under the European Union's Seventh Framework Programme (FP7/2007-2013)/ERC grant agreement n° FP7-GA-2013-321209.

FIELD

The invention relates to a mass spectrometer, in particular an inductively coupled plasma mass spectrometer (ICP-MS) and its uses for determining atomic or molecular species present in samples. The invention furthermore relates to methods of mass spectrometry.

INTRODUCTION

Mass spectrometry is an analytical method for qualitative and quantitative determination of molecular species present in samples, based on the mass to charge ratio and abundance of gaseous ions.

In inductively coupled plasma mass spectrometry (ICP-MS), atomic species can be detected with high sensitivity and precision, at concentrations as low as 1 in $10^{15}$ with respect to a non-interfering background. In ICP-MS, the sample to be analyzed is ionized with an inductively coupled plasma (ICP) and subsequently separated and quantified in a mass analyzer.

Precise and accurate isotope ratio measurements very often provide the only way to gain deeper insight into scientific questions which cannot be answered by any other analytical technique. Multicollector ICP-MS is an established method for high precision and accurate isotope ratio analysis. Applications of ICP-MS are in the field of geochronology, geochemistry, cosmochemistry, biogeochemistry, environmental sciences as well as in life sciences. However, elemental and molecular interferences in the mass spectrometer can limit the attainable precision and accuracy of the analysis.

These interferences can be present in the sample material itself or are generated by sample preparation from a contamination source, such as chemicals used, sample containers, or by fractionation during sample purification. Contaminating species can also be generated in the ion source or in the mass spectrometer.

In order to achieve high precision and accurate isotope ratio measurements, extended physical and chemical sample preparation is often applied to get clean samples free from possible interferences and contamination that can interfere in the mass spectrum. Typical concentrations of analyte in sample material used in isotope ratio ICP-MS are in the range of parts per billion. The analyte of interest may also be concentrated in small inclusions or crystals within a heterogeneous sample material, for example in rock samples.

Extended quality control steps are frequently integrated into sample preparation to ensure that the sample preparation itself does not lead to changes in the isotope ratio of the sample material. Every sample preparation step comes along with the possibility of adding contamination to the samples and/or causing isotopic fractionation of the analyte to be extracted from the original sample material, which could be for instance a rock, a crystal, soil, a dust particle, a liquid and/or organic matter. Even if all these steps are taken with great care there still is the chance of contamination and incomplete separation and interferences in the mass spectrum.

Ideally one would like to completely avoid the chemical sample preparation step. Moreover a chemical sample preparation is impossible if a laser is used to directly ablate the sample and flush the ablated material into the ICP source. In such cases, there is no chemical separation of the desired analyte from the sample matrix and all the specificity has to come from the mass analyzer and the sample introduction system in the mass analyzer. Specificity describes the ability of an analyzer to unambiguously determine and identify a certain species in a sample. One way to achieve specificity in a mass spectrometer is to ensure that the mass resolving power $M/(\Delta M)$ of the mass analyzer is large enough to clearly separate one species from another species where $\Delta M$ indicates the mass difference between the species and M is the mass of the species of interest. This requires very high mass resolution in case of isobaric interferences of species with the same nominal mass. For sector field mass spectrometers high mass resolution comes along with using very narrow entrance slits to the mass analyzer and the small entrance slits significantly reduce the transmission and thus the sensitivity of the mass analyser. As a consequence, this becomes an unpractical approach where very high mass resolving power is required. This is a special challenge for mass spectrometry instrumentation where current technical solutions are limited.

The Inductively Coupled Plasma (ICP) ion source is a very efficient ion source for elemental and isotopic analysis using mass spectrometry. This is an analytical method that is capable of detecting elements at very low concentration, as low as one part in $10^{15}$ (part per quadrillion, ppq) on non-interfered low-background isotopes. The method involves ionizing the sample to be analysed with an inductively coupled plasma and then using a mass spectrometer to separate and quantify the thus generated ions.

Ionizing a gas, usually argon, in an electromagnetic coil, to generate a highly energized mixture of argon atoms, free electrons and argon ions, generates the plasma, in which the temperature is high enough to cause atomization and ionisation of the sample. The ions produced are introduced, via one or more stages of pressure reduction, into a mass analyser which is most commonly a quadrupole analyser, a magnetic sector analyser or a time-of-flight analyser.

A description of ICP mass spectrometers can be found in the articles *A Beginner's Guide to ICP-MS* by Robert Thomas (SPECTROSCOPY 16(4)-18(2), April 2001-February 2003), the disclosure of which is hereby incorporated by reference in its entirety (however, where anything in the incorporated reference contradicts anything stated in the present application, the present application prevails).

A known design of multi-collector (MC) ICPMS instrument is the NEPTUNE™ or NEPTUNE Plus™, as described in brochures and operating manuals from Thermo Scientific™, the disclosures of which are hereby incorporated by reference in their entirety (however, where anything in the incorporated reference contradicts anything stated in the present application, the present application prevails).

High precision mass analysers allow for high mass resolution to separate elemental ions from molecular species which to some extent are inevitably formed inside the ICP source (e.g. $OH^+$, $NO^+$, $CO^+$, $CO_2^+$, $ArO^+$, $ArN^+$, $ArAr^+$, etc.) and interfere with elemental ions. Thus, certain elements are known to have relatively poor detection limits by ICP-MS. These are predominantly those that suffer from artefacts or spectral interferences generated by ions that are derived from the plasma gas, matrix components or the solvent used to solubilize samples. Examples include $^{40}Ar^{16}O$ for determination of $^{56}Fe$, $^{38}ArH$ for determination of $^{39}K$, $^{40}Ar$ for determination of $^{40}Ca$, $^{40}Ar^{40}Ar$ for determination of $^{80}Se$, $^{40}Ar^{35}Cl$ for determination of $^{75}As$, $^{40}Ar^{12}O$ for determination of $^{52}Cr$ and $^{35}Cl^{16}O$ for determination of $^{51}V$.

With a high mass resolution magnetic sector multicollector mass spectrometer the molecular species can be separated along the focal plane of the mass spectrometer so that just the elemental ions can be detected while the molecular interferences are discriminated at the detector slit (see Weyer & Schwieters, International Journal of Mass Spectrometry, Vol. 226, Number 3, May 2003, herein incorporated by reference). This procedure works well for interferences where the relative mass deviation between the analyte and the interference is in the range of $(M/\Delta M)<2{,}000\text{-}10{,}000$ (M: mass of the analyte, $\Delta M$: mass difference between analyte and interference).

With a sector mass spectrometer high mass resolution usually comes along with reduced ion optical transmission into to the mass analyser because high mass resolution requires narrower entrance slits and smaller apertures to minimize second or third order angular aberrations further down the ion beam path from the entrance slit to the detector. In the particular case where the amount of sample is limited or the analyte concentration in a sample is low the reduced sensitivity in high mass resolution mode is a significant problem. It directly results in reduced analytical precision because of poorer counting statistics at effectively reduced transmission through the sector field analyser. Therefore high mass resolution is not generally a practical solution to eliminate interferences and to gain specificity even in cases where the mass resolving power of the mass spectrometer would be sufficient to discriminate the interferences.

There are other applications where isobaric interferences of elemental ions cannot be avoided by sample preparation and where mass resolving power » 10,000 would be required to separate the interfering species. One example is the analysis of $^{40}Ca$ with argon based plasma. There is a strong interference of elemental $^{40}Ar^+$ on $^{40}Ca^+$. The required mass resolution to separate both species would be >193,000 which is much greater than that which can be achieved by a magnetic sector field analyser.

One solution to this problem is provided by collision cell technology (ICP-CCT) that includes a collision/reaction cell that is positioned between the ion source but before the analyser. This collision cell adds another possibility to achieve specificity for the analysis. Instead of mass resolving power it uses chemical reactions to distinguish between interfering species. Into this cell, which typically comprises a multipole operating in a radiofrequency mode to focus the ions, a collision gas such as helium or hydrogen is introduced. The collision gas collides and reacts with the ions in the cell, to convert interfering ions to non-interfering species.

A collision cell may be used to remove unwanted artefact ions from an elemental mass spectrum. The use of a collision cell is described, e.g., in EP 0 813 228 A1, WO 97/25737 or U.S. Pat. No. 5,049,739 B, all herein incorporated by reference. A collision cell is a substantially gas-tight enclosure through which ions are transmitted. It is positioned between the ion source and the main mass analyser. A target gas (molecular and/or atomic) is admitted into the collision cell, with the objective of promoting collisions between ions and the neutral gas molecules or atoms. The collision cell may be a passive cell, as disclosed in U.S. Pat. No. 5,049,739 B, or the ions may be confined in the cell by means of ion optics, for example a multipole which is driven with alternating voltages or a combination of alternating and direct voltages, as in EP 0 813 228. By this means the collision cell can be configured so as to transmit ions with minimal losses, even when the cell is operated at a pressure that is high enough to guarantee many collisions between the ions and the gas molecules.

For example, the use of a collision cell where about 2% $H_2$ is added to He gas inside the cell selectively neutralizes $^{40}Ar^+$ ion by low energy collisions of the $^{40}Ar^+$ with the $H_2$ gas and a resonant charge transfer of an electron from the $H_2$ gas to neutralize the $^{40}Ar^+$ ions (see Tanner, Baranov & Bandura, 2002, Spectrochimica Acta Part B: Atomic Spectroscopy, 57:1361-1452, herein incorporated by reference). This charge transfer mechanism is very selective and efficiently neutralizes argon ions and thus discriminates $^{40}Ar^+$ ions from $^{40}Ca^+$. These types of effects are sometimes called chemical resolution (Tanner & Holland, 2001, in: Plasma Source Mass Spectrometry: The New Millennium, Publisher: Royal Soc of Chem) in comparison to mass resolution in the case of mass spectrometer.

In addition to the charge transfer reaction other mechanisms inside the collision cell using other collision gases or mixtures of collision gases may be applied to reduce interferences. These mechanisms include: kinetic energy discrimination due to collisions inside the collision cell (e.g., Hattendorf & Guenther, 2004, J. Anal Atom Spectroscopy 19:600), herein incorporated by reference), fragmentation of molecular species inside the collision cell (see Koppenaal, D., W., Eiden, G., C. and Barinaga, C., J., (2004), *Collision and reaction cells in atomic mass spectrometry: development, status, and applications,* Journal of Analytical Atomic Spectroscopy, Volume 19, p.: 561-570 herein incorporated by reference), and/or mass shift reactions inside the collision cell. This toolbox of ICP-CCT can come closer to the goal of detection specificity using direct sample analysis with significantly reduced sample preparation but there are still analytical problems and interferences which cannot be resolved by interfacing a collision cell to a mass spectrometer.

By careful control of the conditions in the collision cell, it is possible to transmit the desired ions efficiently. This is possible because in general the desired ions, those that form part of the mass spectrum to be analysed, are monatomic and carry a single positive charge that is, they have lost an electron. If such an ion collides with a neutral gas atom or molecule, the ion will retain its positive charge unless the first ionisation potential of the gas is low enough for an electron to transfer to the ion and neutralise it. Consequently, gases with high ionisation potentials are ideal target gases. Conversely, it is possible to remove artefact ions whilst continuing to transmit the desired ions efficiently. For example the artefact ions may be molecular ions such as $ArO^+$ or $Ar_2^+$ which are much less stable than the atomic ions. In a collision with a neutral gas atom or molecule, a molecular ion may dissociate, forming a new ion of lower mass and one or more neutral fragments. In addition, the collision cross section for collisions involving a molecular ion tends to be greater than for an atomic ion. This was demonstrated by Douglas (Canadian Journal Spectroscopy, 1989 vol 34(2) pp 36-49), incorporated herein by reference. Another possibility is to utilise reactive collisions. Eiden et al. (Journal of Analytical Atomic Spectrometry vol 11 pp 317-322 (1996)) used hydrogen to eliminate many molecular ions and also $Ar^+$, whilst monatomic analyte ions remain largely unaffected.

SUMMARY

The present invention introduces new mass spectrometry methods by which an analyte gas is ionized inside a collision cell through collisions with an ion beam, which is preferably intense, and the ions of the ionized analyte gas are then transmitted into a mass analyser for mass analysis. The ion beam used for this purpose can be mass selected, by use of mass filters as further described herein. The new methods presented herein provide a new operation mode of mass spectrometers, with various applications, e.g. for structural elucidation, site specific isotope analysis, and more.

The invention provides a modified method for isotope ratio mass spectrometry, wherein sample ions are reacted in a collision cell with a charge-neutral reaction gas introduced therein generating an adduct ion species which is mass analysed and the mass spectrum is compared to isotopic mass spectrum of the reaction gas by itself, ionized with an ion beam. Thus, the isotope abundance and/or isotope ratio of the sample ions can be determined and corrected by the measured isotope ratio of the reaction gas.

The present invention provides a method of mass spectrometry, wherein the method comprises steps of:

a. generating an ion beam from an ion source which is suitably an ICP ion source;
b. directing the ion beam into a collision cell,
c. introducing into the collision cell through a gas inlet on the collision cell a charge-neutral analyte gas;
d. creating ions from said analyte gas in the collision cell by means of collisions between the analyte gas and the ion beam;
e. transmitting created ions from the from the collision cell into a mass spectrometry analyzer; and
f. mass analyzing the transmitted ions of the ionized analyte gas, which includes determining an isotope abundance or isotope ratio of said ions in the mass analyzer.

As described in more detail below, the analyte gas may be a reaction gas that is used for a mass shift reaction with sample ions in a separate isotope ratio experiment to resolve the sample ions in a mass spectrum and determine the isotope ratio of the sample ions. By mass analyzing the reaction gas, and preferably determining its isotope abundance and/or isotope ratio, a corrected isotope ratio can be obtained for the sample ions from the mass shift experiment.

It follows that the ion beam is preferably and suitably generated from an inductively coupled plasma (ICP) ion source, by streaming a plasma generating gas into a plasma torch, generating plasma in the torch and extracting ions from the plasma to form the ion beam. In some embodiments the ion beam substantially comprises ions of the plasma generating gas, whereas in other embodiments the ion beam comprises alternatively or additionally other ions than ions of the plasma generating gas, which other ions are introduced through the plasma.

The plasma generating gas is suitably selected from one or more gases conventionally used for generating plasma in an ICP, such as but not limited to Argon, Neon, Helium, Nitrogen, and Oxygen. The ion beam can comprise ions of the plasma generating gas. In certain embodiments the ion beam comprises at least one ion species selected from $^{36}Ar^+$, $^{38}Ar^+$, $^{40}Ar^+$, and $^{40}Ar_2^+$. In a preferred embodiment, the ion beam comprises $^{40}Ar^+$ ions.

In those embodiments where the ion beam comprises other ions than ions of the plasma generating gas, the method may suitably comprise introducing a solution or gas comprising a target species into the plasma thereby generating ions of the target species. In some of these embodiments the ion beam may substantially comprise ions of the target species. This can be conveniently achieved by mass filtering selected target species ions. The target species can preferably be an element, and the target species ions elemental ions.

Thus, in some embodiments the ion beam substantially comprises elemental ions. In some of such embodiments and other embodiments the ion beam comprise mass filtered elemental ions of a single elemental species.

The ion beam which is received in the collision cell is preferably configured and controlled to a desired and useful intensity such as a beam intensity between 10 pA and 100 nA, with the upper end of this range being more preferable (10-100 nA). Such currents are achievable with a plasma ion source, such as an argon plasma ion source. The energy of the ion beam is preferably within an energy range from about 0 to about 250 eV, and more preferably in the range from about 5 ev or from about 10 eV to about 250 eV or to about 200 eV or to about 100 eV, for example about 50 eV. It follows that in some useful embodiments the energy of the ion beam is controllable, such as for example by use of an acceleration electrode upstream of the collision cell.

As mentioned above, ions of the ion beam can be mass selected before entry to the collision cell. This is suitably done using a mass filter located between the ion source and the collision cell.

The collision cell, sometimes also called a reaction cell, can comprise a chamber that has at least one gas inlet. The chamber further can have an ion inlet, for admitting ions into the chamber, and an ion outlet, through which ions are transmitted towards a downstream mass analyser. The collision cell can be of any suitable shape and dimension. In certain embodiments the collision cell comprises at least one chamber, which comprises at least one ion guide.

In general, the collision cell preferably contains at least one gas inlet for supplying the charge-neutral analyte gas, collision gas or reaction gas into the cell. One, or two, or more gases can be supplied to the cell through a gas inlet. Alternatively, the cell may comprise two or more gas inlets for respectively supplying two or more gases into the cell. In some embodiments introduced gas can be used to cool down the ion beam in the collision cell. By cooling the ion beam the collision gas can preferably reduce both the absolute kinetic energy of the ions in the ion beam and also reduce the spread of kinetic energies which the ions have. The gas inlet can further comprise, or be in fluid communication with, a gas flow controller for controlling the flow gas into the collision cell. The gas flow controller can for example be a mass flow controller.

The collision cell can be a passive cell, such as disclosed in U.S. Pat. No. 5,049,739 B, the entire contents of which are hereby incorporated by reference, or the ions may be confined in the cell by means of ion optics, for example a multipole which is driven with alternating voltages or a combination of alternating and direct voltages, as in EP 0 813 228, the entire contents of which are hereby also incorporated by reference. By this means the collision cell can be configured so as to transmit ions with minimal losses, even when the cell is operated at a pressure that is high enough to guarantee many collisions between the ions and the gas molecules. The collision cell can comprise at least one quadrupole, at least one hexapole, or at least one octupole. Preferably, the multipole is operated in an RF (radio frequency)-only mode, i.e. there is no mass selection in the collision cell, but instead the multipole has the effect of focusing the ions within the cell.

The collision cell can be linear, and the axis of the ion beam through the cell also linear. However, the collision cell can also be non-linear, for example when provided as a curved multipole assembly. Accordingly, the axis of the collision cell can be linear or it can be curved or non-linear. The axis can also be partially linear and partially non-linear. The collision cell can comprise a parallel, straight multipole, or the collision cell can comprise a curved multipole. The curved multipole can be provided as a multipole, such as a quadrupole, wherein the distance between the rods decreases from the entrance and exit of the collision cell towards the middle of the cell.

The quadrupole can be a three-dimensional quadrupole or it can be a two-dimensional, i.e., linear, quadrupole. The rods of the multipole can be round rods, or they can be hyperbolic rods. In some embodiments, the multipole is a flatapole, in which the rods are flat, i.e. the rods have at least one flat surface.

Preferably, the collision cell is arranged upstream of the mass analyser of the mass spectrometer. The collision cell can be arranged between an upstream mass filter and a downstream mass analyser.

The mass filter can be a mass filter that comprises electrodes that are provided with a combination of RF and DC voltages in a mass-to-charge (m/z) filtering mode, and are provided with substantially only RF voltage in a non-filtering mode. In other words, the non-filtering mode is preferably an RF-only mode. In this mode, the ions of all mass to charge ratios are stable within the mass filter and as a consequence will be transmitted through it. It is possible that a small DC voltage be applied to the electrodes, in addition to the RF voltage, during the transmission mode. Preferably, the DC/RF voltage ratio in the non-filtering mode is 0.0 (i.e., RF only, no DC voltage), or no more than 0.001, or no more than 0.01, or no more than 0.05, or no more than 0.1. Preferably, the DC/RF ratio is 0.0.

Preferably, the mass filter is a multipole filter. The electrodes of the mass filter are therefore preferably the rods of a multipole mass filter. The multipole can be a quadrupole, a hexapole, or an octupole. Preferably, the multipole is a quadrupole. The quadrupole can be a three-dimensional quadrupole or it can be a two-dimensional, i.e., linear, quadrupole. Preferably, the quadrupole is a linear quadrupole mass filter. The rods of the multipole can be round rods, or they can be hyperbolic rods. In the mass selecting by the mass filter a mass window can be set with a width of about 2 amu or less, such as preferably of about 1 amu or less, and more preferably of about 0.7 amu.

In certain embodiments, a quadruple mass filter incorporates RF-only pre- and post-filter sections to the quadrupole assembly to achieve high transmission at the quadrupole entrance and to better control the ion beam phase volume at the exit of the quadrupole.

By adjusting the energy of the ion beam it is possible to select an energy level of the ion beam that results in at least a portion of the analyte gas to be fragmented, to form at least one ionized atomic or molecular fragment species of the analyte gas. The formed ionized fragment species is then suitably transmitted to the mass analyser and mass analysed. It follows that the energy of the ion beam can be suitably adjusted to favour the formation of a desired ionized fragment of the analyte gas.

The above features make possible specific analysis of one or more organic compound, introduced as the analyte gas, and mass analysed with the above methods. The methods can be used in isotopic measurements e.g. isotope ratio measurements, such as site specific isotope ratio measurements, and an organic compound to be analysed can comprise besides carbon and hydrogen, one or more of the elements oxygen, nitrogen, sulphur, halogen and phosphorous. In some embodiments the one or more organic compound selected from but not limited to the group consisting of: hydrocarbons, substituted hydrocarbons, proteins, lipids, carbohydrates, and nucleic acids.

It will be appreciated that the method is useful in embodiments where the analyte gas comprises a reaction gas that is used to fill the collision cell in a separate isotope ratio experiment to react with sample ions that are introduced into the collision cell from the ion source. For example, the reaction gas can be used to react with sample ions to form adduct ion species, and the isotope abundance and/or isotope ratio of these adduct ions can then be determined in the mass analyser. For example, the sample ions can have an isobaric interference that prevents an accurate isotope ratio determination of its ions. The use of the reaction gas can avoid the interference by reacting the reaction gas with the sample ions but hardly or not at all with the isobaric interference ions. The adduct ions are thus free from the interference. This is especially useful when used with the mass filter so that a mass window is selected by the mass filter that allows transmission of ions with the mass-to-charge ratio of the sample ions but not the mass-to-charge ratio of the adduct ions (i.e. does not allow transmission of interfering ions that could interfere with the mass spectrum of the adduct ions formed in the collision cell). In a separate experiment (measurement) the isotope abundance of the reaction gas itself can be determined, i.e. involving ionising the reaction gas in the collision cell using the ion beam, and thus it is possible to determine from the comparison of these obtained data, the isotope abundance or isotope ratio of the sample ions with improved accuracy. This is particularly useful when the direct isotope abundance of the sample ions is confounded by interfering species.

It follows from the above that the analyte gas in the methods disclosed herein can essentially be any substance or mixture of substances that can be introduced in gaseous form into the collision cell. This includes but is not limited to substances such as helium, hydrogen, oxygen, nitrogen, ammonia, methane, ethane, propane, isobutane, n-butane, carbon dioxide, nitric oxide, nitrogen dioxide, nitrous oxide, diborane, and/or sulfur dioxide, or mixtures of any two or more of such substances. The substance can be introduced such as through a variable leak valve, or through other means known to the skilled person. In yet other embodiments species that are not gaseous under normal conditions can be gasified in order to be introduced into the collision cell, such as by use of a gas chromatograph coupled to an entry valve, such as with a suitable transfer line. Accordingly, a wide range of substances and compounds can be introduced and used as analyte gas/reaction gas and entered into the collision cell, through various means well known to the skilled person, and such substance or compound can be (i) analysed directly and accurately with the mass analyser such as for obtaining isotope ratios and isotope profiles, and (ii) reacted with sample ions to form product species such as but not limited to adduct species.

As mentioned above, it is useful in many applications that the isotope abundance or isotope ratio of the ionized analyte gas can be determined in the mass analyser. The methods of the invention are applicable to various different mass analysers, including but not limited to magnetic sector mass analysers including single collector and multicollector sector mass analysers, quadrupole mass analysers, time of flight (TOF) mass analysers , ion trap mass analysers, and electrostatic trap mass analysers including orbital electrostatic traps such as the Orbitrap™.

In another aspect based on what has been described above, the invention provides a method of isotope ratio mass spectrometry, which method comprises the steps of:

a. determining an isotope abundance and/or ratio of sample ions, by
   - introducing the sample ions into a collision cell;
   - providing at least one reaction gas in the collision cell to react with the sample ions;
   - reacting the sample ions with the reaction gas in the collision cell to generate at least one chemical adduct ion species resulting from the reaction of the sample ions and the reaction gas; and
   - determining an isotope abundance and/or isotope ratio of the sample ions by mass analysis of the chemical adduct ion species;
b. determining an isotope abundance and/or isotope ratio of the reaction gas, by
   - ionizing the reaction gas in the collision cell by means of an ion beam, so as to generate at least one reaction gas ion species in the collision cell; and
   - determining the isotope abundance and/or isotope ratio of the at least one reaction gas by mass analysis of the at least one reaction gas ion species; and
c. adjusting/correcting the determination of the isotope abundance and/or ratio of the sample ions from step a based on the isotope abundance and/or ratio of the reaction gas determined in step b.

The reaction gas referred to in this method is preferably selected from one or more of the gases mentioned above referring to analyte gases, such as but not limited to helium, hydrogen, oxygen, nitrogen, ammonia, methane, ethane, propane, isobutane, n-butane, carbon dioxide, nitric oxide, nitrogen dioxide, nitrous oxide, diborane, and sulfur dioxide. The method preferably generates the at least one reaction gas ion species in the collision cell that is free of sample ions (i.e. the ion beam does not contain the sample ions when used to ionise the reaction gas). Determining the isotope abundance and/or ratio of the reaction gas (the above 'step b') can be performed before or after determining the isotope abundance and/or ratio of the sample ions. That is, the steps a. and b. can be performed in any order, i.e. step a. followed by step b., or step b. followed by step a.

As can be understood, it is advantageous to generate the sample ions in the above method in an ICP, as described above. In some embodiments it is particularly advantageous that the ion beam for ionising the reaction gas is generated from the same ICP source as the sample ions. Hence, in some embodiments the ion beam is generated by streaming a plasma generating gas into a plasma torch and the ion beam substantially comprises ions of the plasma generating gas. The plasma generating gas is in certain embodiments argon gas.

The aforementioned method can further comprise mass filtering an ion beam comprising the sample ions and/or an ion beam that is free of sample ions prior to transmitting the sample ions and/or the ion beam into the collision cell. The method can comprise selecting the energy of an ion beam comprising the sample ions and/or the ion beam that is free of sample ions prior to transmitting the sample ions and/or the ion beam into the collision cell. For example, the sample ions can have an isobaric interference (for example the extent of which may be unknown) that prevents an accurate isotope ratio determination of its ions. The use of the reaction gas can avoid the interference by reacting the reaction gas with the sample ions but hardly or not at all with the isobaric interference ions. The adduct ions are thus free from the interference. This is especially useful when used with the mass filtering step so that a mass window is selected by the mass filter that allows transmission of ions with the mass-to-charge ratio of the sample ions but not the mass-to-charge ratio of the adduct ions (i.e. does not allow transmission of interfering ions that could interfere with the mass spectrum of the adduct ions formed in the collision cell). The mass filtering of the ion beam when used to ionise the reaction gas can select a mass-to-charge ratio or range that encompasses ions of the plasma generating gas, e.g. argon ions, especially the most abundant isotope thereof, $^{40}Ar^{+}$. The mass filtering may select a mass window width of about 2 amu or less, such as preferably of about 1 amu or less, and more preferably of about 0.7 amu. In this way, an intense ion beam may be selected and directed into the collision cell to ionise the reaction gas.

An inductively coupled plasma (ICP) source is a plasma source in which energy is supplied by electric currents which are produced by electromagnetic induction, that is, by time-varying magnetic fields. The inductively coupled plasma (ICP) source can be any such source that is known to the skilled person. For example, the ICP source comprises a plasma torch that comprises three concentric tubes, which can for example be made from quartz. The ICP source can further comprise an electrode that has a helical shape and that, when a time-varying electric current is applied thereto, will create a time-varying magnetic field. The ICP source can be adapted to be operable with any suitable gas for plasma generation, such as argon gas.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

In the following, exemplary embodiments of the invention will be described, referring to the figures. These examples are provided to provide further understanding of the invention, without limiting its scope.

In the following description, a series of steps are described. The skilled person will appreciate that unless required by the context, the order of steps is not critical for the resulting configuration and its effect. Further, it will be apparent to the skilled person that irrespective of the order of steps, the presence or absence of time delay between steps, can be present between some or all of the described steps.

It should be appreciated that the invention is applicable for mass analysis of materials in general, such as gases, liquids, solids, particles and aerosols. In general, therefore, the sample that is being analyzed in the system will be variable.

Figure 1:
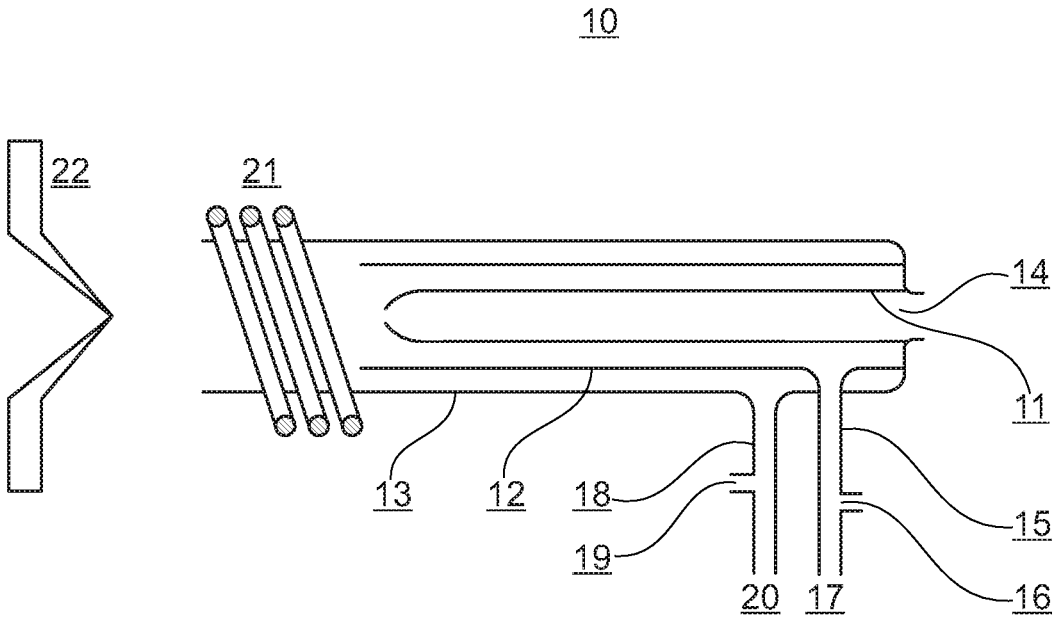
FIG. 1 shows an Inductively Coupled Plasma (ICP) source in accordance with the invention, indicating two alternate configurations for introduction of reaction gas into the ICP source

An Inductively Coupled Plasma (ICP) source 10 in accordance with the invention is shown in FIG. 1. The ICP source exemplified contains three concentric tubes 11, 12, 13 which are typically made from quartz, and a load coil 21. As known in the art, plasma gas can be introduced through the sample inlet 14 into the inner tube 11, an auxiliary gas inlet 17 via an auxiliary gas line 15 into the middle tube 12 and/or a cooling gas inlet 20 via a cooling gas line 18 into the outer tube 13. The load coil 21 couples a very intense RF field into the argon gas flow (auxiliary gas and cooling gas). As a result of the high amount of energy (and an initial spark for seeding electrons), a plasma is generated and sustained with temperatures typically in the range of >8000° C.

A sample is introduced through the sample inlet 14, typically in a plasma gas such as Argon. The sample can be an aerosol that is generated by a means of a nebulizer and a spray chamber, as further illustrated in FIG. 2. Optionally, any other gas species to be ionised can be introduced into the ICP source through the sample inlet 14 together with the sample, or alternatively, or additionally, via optional inlets 16, 19 on the auxiliary gas inlet line 15 and/or the cooling gas inlet line 18, respectively.

Figure 2:
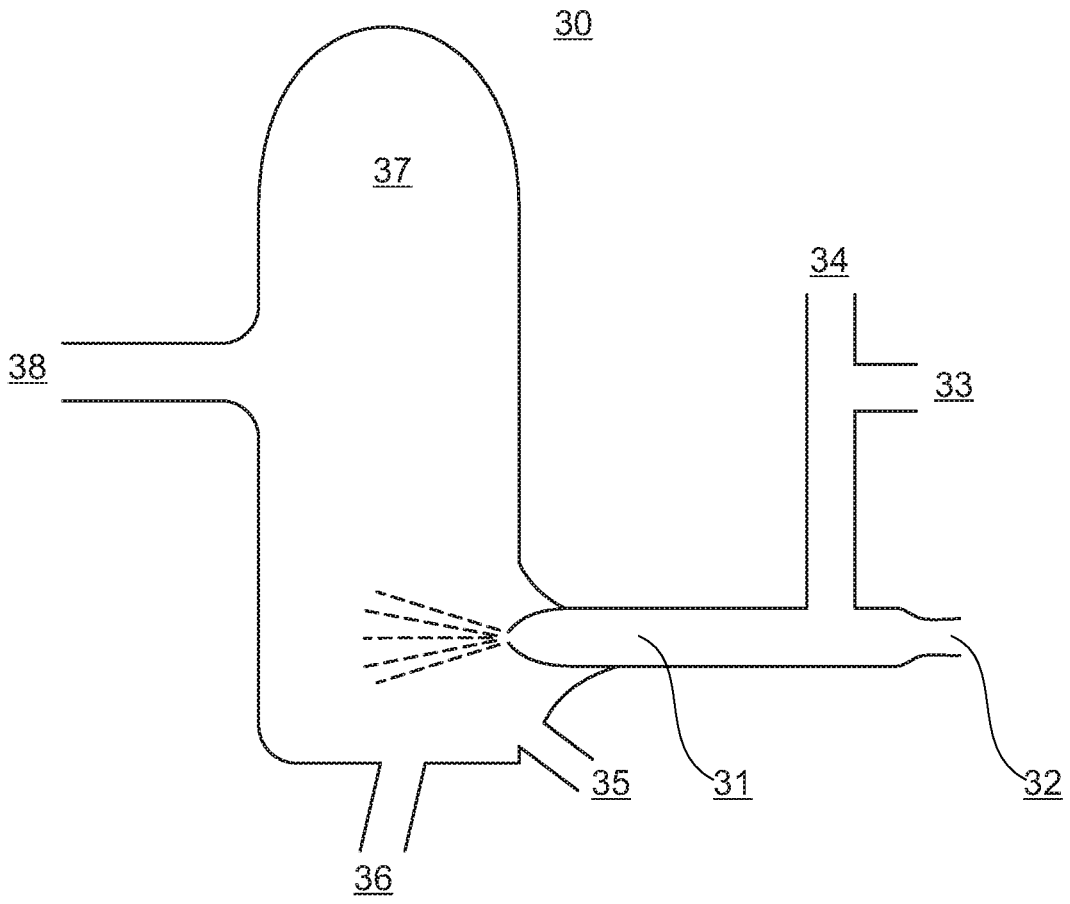
FIG. 2 shows a sample introduction system that consists of a nebulizer and a spray chamber, for introducing an aerosol into the ICP source. Two alternate configurations for introducing a reactive species into the sample introduction system are indicated.

The sample can be introduced into a sample introduction system such as a spray chamber assembly 30, as illustrated in FIG. 2. The assembly includes a nebulizer 31, which has a sample inlet 32, and a nebulizer gas inlet 34, which typically will be identical to the plasma gas (such as Argon). An optional inlet 33 can be provided on the nebulizer gas inlet, and that can be used to provide any additional gas, in mixture with the nebulizer gas, into the nebulizer.

The nebulizer delivers a sample spray into the spray chamber 37, which has a drain 36 and an outlet 38 that feeds into the sample inlet 14 of the ICP source 10. The spray chamber can optionally further have a gas inlet 35 that can be used to deliver further gas into the spray chamber, where it will form a mixture with the sample aerosol and be delivered into the ICP source through the outlet 38.

Thus, alternative embodiments for delivering sample gas into the spray chamber assembly are possible. These embodiments can be used alternatively, or they can be used in combination.

The ions generated in the plasma enter the mass spectrometer via an interface comprising one or more cones 22.

Figure 3:
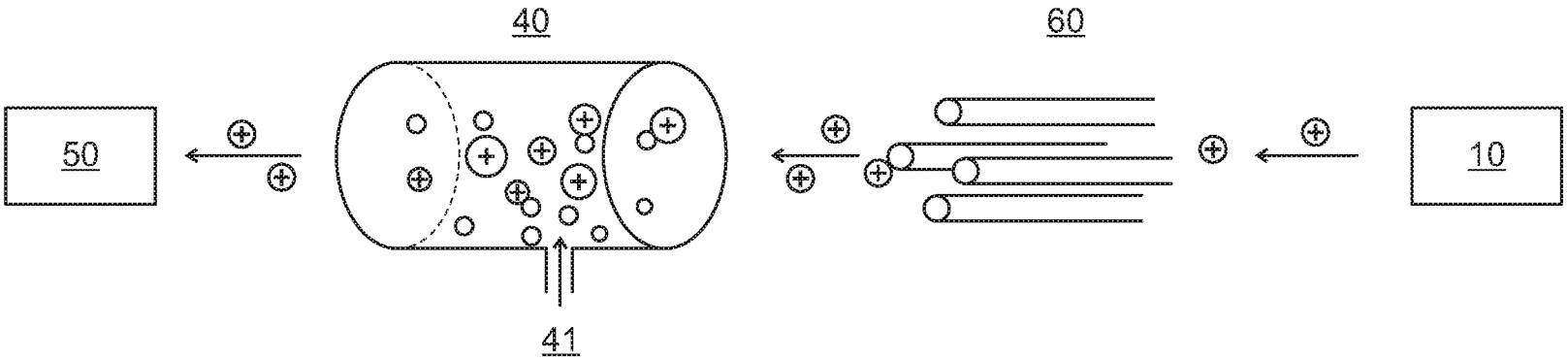
FIG. 3 shows schematic illustration of a mass spectrometer that can be used with the invention, highlighting the collision cell and upstream mass filter.

In FIG. 3, a mass spectrometer that can be used to practice the invention is shown. Downstream from the ICP source 10 there is a quadrupole mass filter 60. The mass filter can be used to selectively transmit ions that are of interest, or ions in a mass range of interest, for delivery into the collision cell and subsequent mass analysis in the downstream mass analyser. Alternatively, the mass filter can be used to selectively transmit the intense ion beam from the ICP source, for ionizing gas inside the collision cell.

The collision cell 40 receives ions that are transmitted by the upstream mass filter 60. The collision cell further has a gas inlet 41, for receiving charge-neutral collision/reaction gas that reacts with ions inside the collision cell. For example, the incoming ions may be ions from the $Ar^+$ ion beam that is generated in the ICP source, and that have been selectively transmitted by the upstream mass filter 60. The ion beam can ionize the charge-neutral collision gas (e.g., oxygen), and the thus generated ions of the collision/reaction gas can be mass analysed in the downstream mass analyzer.

Alternatively, the gas inlet 41 can be used to deliver analyte gas into the collision cell that can be ionized and/or fragmented inside the collision cell by the incoming ion beam (e.g. the $Ar^+$ ion beam). The thus generated ions and/or ionized fragments of the analyte can be mass analysed in the downstream mass analyser 50. Thereby, the incoming ion beam is used to ionize the charge-neutral analyte, for subsequent mass analysis.

The ions that are generated inside the collision cell are subsequently directed to a downstream mass analyser 50, wherein the ions are mass analysed. The mass analyser can in principle be any suitable mass analyser, such as a single or dual sector mass analyser (e.g., a dual sector multicollector), a quadrupole mass analyser, an ion trap mass analyser, a time of flight mass analyser, or an electrostatic trap mass analyser, including an orbitrap mass analyser.

The following non-limiting examples provide exemplary descriptions of certain analytical benefits of the present invention.

EXAMPLE 1

This experiment is designed to determine titanium (Ti) isotopic abundances in a sample containing titanium and chromium (Cr). Of specific interest is the abundance of the $^{50}Ti$ isotope. In this example the sample is directly introduced into the ICP ion source by laser ablation so there is no opportunity to separate Ti from Cr before the analysis and all the specificity in the analysis has to be achieved in the mass spectrometer. This is problematic as the $^{50}Ti$ isotope has isobaric interferences with $^{50}Cr$ which must be resolved or corrected for in order to achieve an accurate determination of $^{50}Ti$.

The experiment comprises two parts, first using the mass filter to permit a specified mass range into the collision cell, introduce oxygen gas into the collision cell in order to form TiO adduct ion in a mass shift reaction and then mass analyse the adduct ions to determine the isotopic abundance of $^{50}Ti$ and/or a ratio of $^{50}Ti$ with another Ti isotope. In the second part the mass filter is set to permit only the intense $^{40}Ar$ ion beam from the plasma ion source to enter the collision cell. Oxygen gas is introduced into the collision cell under the same conditions as in the first part of the experiment. The intense $^{40}Ar$ beam undergoes charge exchange reactions with the neutral $O_2$ gas, causing ionisation and dissociation of the $O_2$ gas. The resulting oxygen ions then exit the collision cell and can be mass analysed for their isotope ratio. The known isotope ratio of the oxygen gas can then be used to more accurately correct for the presence of minor isotope oxides which will be present in the first experiment.

Experiment Details

For the first part the sample is introduced via laser ablation to the Ar plasma ion source of the instrument to produce $Ti^+$ and $Cr^+$ ions. As Cr isotopes have isobaric interferences to the target $^{50}Ti$ isotope these species must be separated in the mass spectrometer. Then use is made of the chemical resolution that can be achieved with the collision cell and introduce oxygen gas into the collision cell. The selective reactivity of the different elements to preferentially promote $Ti^+$ away from interfering $Cr^+$ is exploited by forming $TiO^+$ from the sample $Ti^+$ and $O_2$ gas. As this reaction is orders of magnitude more efficient for $TiO^+$ compared to $CrO^+$ the Ti species can be successfully separated from Cr in the mass spectrum. The resultant TiO species formed in the collision cell is now present at mass 62-66 in the copper and zinc spectrum and this can be measured in the downstream mass analyser. To avoid a need to make a complicated correction of the potential presence of copper and zinc in the sample, the mass filter located before the collision cell is suitably used to transmit only a selected range of masses. In this example we consider that we have a mass window of ±10 centred on $^{50}Ti$. This allows transmission of all isotopes of Ti and Cr but crucially does not allow transmission of copper or zinc into the collision cell. Thus the adduct $TiO^+$ ions created in the cell can be measured in the copper and zinc mass range but in absence of copper and zinc from the sample as this does not pass the first mass filter. Thus the $^{50}Ti$ abundance and Ti isotope ratio can be determined in the sample without interference from Cr.

The second part allows for more accurate assessment of the $^{50}Ti$ abundance to be made in the sample by accounting for the presence of minor oxide isotopes by determining the isotopic composition of the reaction gas (oxygen). Whilst the promotion of $Ti^+$ ions to $TiO^+$ ions in the collision cell can effectively separate Ti from Cr in the sample, the oxide promotion scheme creates further isobaric interferences from the presence of $TiO^+$ species which have been formed from the minor oxygen isotopes $^{17}O$ and $^{18}O$ e.g. $^{48}Ti^{18}O$ which is isobaric to the target $^{50}Ti^{16}O$. These interferences may only be present in small amounts e.g. $^{18}O$ is only ~0.2% of all oxygen but in the case where a major Ti isotope/minor oxygen pair interferes with a minor Ti isotope/major oxygen pair this contribution may be significant enough to lead to an inaccuracy in the Ti isotope measurement. For example $^{48}Ti^{18}O$ will contribute about 3% to the beam measured at mass 66 for $50Ti^{16}O$.

Corrections for these interferences can be made by monitoring an uninterfered minor isotope oxide such as 50Ti18O at mass 68 and making corrections based on reference isotope ratios for oxygen. However for the highest accuracy in the determination of Ti isotope abundances and ratios it would be desireable to characterise the isotopic composition of the oxygen gas that is being supplied to the collision cell. This could be achieved by a separate off line analysis of the gas but one would also like to know if introduction to and exit from the collision cell causes isotopic fractionation of the gas. In order to measure this, oxygen is first introduced to the collision cell under identical conditions as for the Ti isotope ratio analysis. The mass filter located before the collision cell is then set to introduce only the dominant $^{40}Ar$ ion from the plasma into the collision cell. The $^{40}Ar$ ion has a higher ionisation potential than the $O_2$ molecule and undergoes charge exchange with the molecule which dissociates and ionises the $O_2$ to $O^+$. The oxygen ions then exit the collision cell and the isotopic composition of the oxygen gas can be analysed in the main mass analyser. This determination of the isotope ratio of the oxygen reaction gas can then be used to correct for the contribution of minor oxide species to the Ti isotope ratio measurements made in the experiment in part 1. This method has advantages over using reference ratio for the reaction gas isotope ratio as it allows for correction of any fractionation in the isotope composition which may occur in the introduction of the reaction gas to the cell or when molecular adduct ion leaves the reaction cell.

The atomic and molecular species considered from this example are shown below in Table 1.

TABLE 1

Atomic and molecular species considered in Example 1.

| Mass | 46 | 47 | 48 | 49 | 50 | 51 | 52 |
|---|---|---|---|---|---|---|---|
| Species | $^{46}Ti$ | $^{47}Ti$ | $^{48}Ti$ | $^{49}Ti$ | $^{50}Ti$<br>$^{50}V$<br>$^{50}Cr$ | $^{51}V$ | $^{52}Cr$ |

| Mass | | 62 | 63 | 64 | 65 | 66 | 67 | 68 |
|---|---|---|---|---|---|---|---|---|
| Species | $^{16}O$<br>$^{17}O$<br>$^{18}O$ | $^{46}Ti^{16}O$ | $^{47}Ti^{16}O$<br>$^{46}Ti^{17}O$ | $^{48}Ti^{16}O$<br>$^{47}Ti^{17}O$<br>$^{46}Ti^{18}O$ | $^{49}Ti^{16}O$<br>$^{48}Ti^{17}O$<br>$^{47}Ti^{18}O$ | $^{50}Ti^{16}O$<br>$^{49}Ti^{17}O$<br>$^{48}Ti^{18}O$ | $^{50}Ti^{17}O$<br>$^{49}Ti^{18}O$ | $^{50}Ti^{18}O$ |

For example, it can be seen that the $^{46}Ti^{16}O$ species can be measured uninterfered at mass 62. The measured abundance (intensity) at mass 63, however, is made up mainly of $^{47}Ti^{16}O$ with a small contribution from $^{46}Ti^{17}O$. From the isotopic measurement of the oxygen reaction gas, the ratio of $^{16}O$:$^{17}O$ is known, and hence the abundance of $^{46}Ti^{17}O$ can be determined from the measured abundance of the uninterfered $^{46Ti}16O$. As the abundance of $^{46}Ti^{17}O$ is now determined, the corrected abundance of $^{47}Ti^{16}O$ can be determined from the mass 63 measurement and hence the corrected isotope ratio $^{47}Ti$:$^{46}Ti$ can be obtained. This method can be applied to the other mass measurements to obtain corrected isotope ratios of the other Ti isotopes.

EXAMPLE 2

This experiment is designed to determine the site specific isotope composition of carbon isotopes in a propane molecule. In this experiment ions are generated in the ICP ion source and extracted from the plasma. The first mass filter is used to select only the $^{40}Ar^+$ ion which is an intense ion beam and transmit this into the collision cell. Through the gas inlet of the collision cell we introduce the propane analyte gas. Propane is a saturated alkane molecule with a three-carbon chain. Using an accelerating electrode located before the collision cell, the ion energy is controlled of the incident $^{40}Ar^+$ ion which interacts with the propane molecule causing fragmentation and ionisation of the molecule along the $C_1$ to $C_2$ bond. Thus the charge neutral propane molecule with three carbons and 8 hydrogens is split into two fragments one of 1 carbon and 3 hydrogens and a second of 2 carbons and 5 hydrogens.

These molecular ion fragments then exit the collision cell and may be mass analysed by the second mass analyser. The power of this technique is that by monitoring the both masses 15 ($^{12}CH_3$) and 16 ($^{13}CH_3$), as well as 24 ($^{12}C_2H_3$) and 25 ($^{13}C^{13}C_3$) one can determine the isotopic composition of the position specific carbon in the propane molecule, i.e. one can determine the carbon isotopic composition of the $C_1$ carbon and the $C_{2-3}$ carbon cluster. If the incident $^{40}Ar^+$ can be used to induce further fragmentation of the propane molecule in the collision cell and sufficient mass resolution can be achieved in the second mass analyser ($m/\Delta m$ ~3500) then one may even choose to monitor masses 14 ($^{12}CH_2$) and 15 ($^{13}CH_2$) for the isotopic composition of the $C_2$ carbon at the same time as the 15 ($^{12}CH_3$) and 16 ($^{13}CH_3$) for the isotopic composition of the $C_1$.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. A method of isotope ratio mass spectrometry, comprising:

a. determining an isotope abundance and/or ratio of sample ions, by
   introducing the sample ions into a collision cell;
   providing at least one reaction gas in the collision cell to react with the sample ions;
   reacting the sample ions with the reaction gas in the collision cell to generate at least one chemical adduct ion species resulting from the reaction of the sample ions and the reaction gas; and
   determining an isotope abundance and/or isotope ratio of the sample ions by mass analysis of the chemical adduct ion species;

b. determining an isotope abundance and/or isotope ratio of the reaction gas, by
   ionizing the reaction gas in the collision cell by means of an ion beam, so as to generate at least one reaction gas ion species in the collision cell that is free of sample ions; and
   determining the isotope abundance and/or isotope ratio of the at least one reaction gas by mass analysis of the at least one reaction gas ion species; and c. adjusting/correcting the determination of the isotope abundance and/or ratio of the sample ions from step (a) based on the isotope abundance and/or ratio of the reaction gas determined in step (b).

2. The method of claim 1, wherein the determining of the isotope abundance and/or ratio of the reaction gas is performed before determining the isotope abundance of the sample ions.

3. The method of claim 2, further comprising mass filtering an ion beam comprising the sample ions and/or an ion beam that is free of sample ions prior to transmitting the sample ions and/or the ion beam into the collision cell.

4. The method of claim 2, further comprising selecting the energy of an ion beam comprising the sample ions and/or the ion beam that is free of sample ions prior to transmitting the sample ions and/or the ion beam into the collision cell.

5. The method of claim 1, wherein the sample ions are generated in an inductively coupled plasma (ICP) source.

6. The method of claim 5, wherein the ion beam is generated in the same inductively coupled plasma (ICP) source as the sample ions.

7. The method of claim 1, wherein the ion beam is generated by streaming a plasma generating gas into a plasma torch such that the ion beam substantially comprises ions of the plasma generating gas.

* * * * *